US008734228B2

(12) United States Patent
Bryant et al.

(10) Patent No.: US 8,734,228 B2
(45) Date of Patent: May 27, 2014

(54) MEMBERSHIP REWARD SYSTEM

(75) Inventors: Natalie Bryant, Cherrybrook (AU); Scott Olive, Balgowlah (AU)

(73) Assignee: Aristocrat Technologies Australia Pty Ltd (AU)

( * ) Notice: Subject to any disclaimer, the term of this patent is extended or adjusted under 35 U.S.C. 154(b) by 1174 days.

(21) Appl. No.: 11/944,015

(22) Filed: Nov. 21, 2007

(65) Prior Publication Data

US 2008/0064495 A1 Mar. 13, 2008

Related U.S. Application Data

(63) Continuation of application No. 10/275,364, filed as application No. PCT/AU01/00497 on May 2, 2001, now Pat. No. 7,318,774.

(51) Int. Cl.
*A63F 9/00* (2006.01)

(52) U.S. Cl.
USPC ..... 463/25

(58) Field of Classification Search
USPC ..... 463/29
See application file for complete search history.

(56) References Cited

U.S. PATENT DOCUMENTS

| | | | | |
|---|---|---|---|---|
| 5,655,961 | A | 8/1997 | Acres | |
| 5,766,076 | A | 6/1998 | Pease | |
| 5,833,540 | A | 11/1998 | Miodunski | |
| 6,039,648 | A | 3/2000 | Guinn | |
| 6,135,884 | A | 10/2000 | Hedrick | |
| 6,319,125 | B1 | 11/2001 | Acres | |
| 6,364,768 | B1 | 4/2002 | Acres | |
| 7,192,352 | B2 * | 3/2007 | Walker et al. | 463/42 |
| 7,318,774 | B2 * | 1/2008 | Bryant et al. | 463/25 |
| 7,740,538 | B2 * | 6/2010 | Nguyen et al. | 463/25 |
| 2003/0100361 | A1 * | 5/2003 | Sharpless et al. | 463/25 |
| 2004/0038736 | A1 * | 2/2004 | Bryant et al. | 463/29 |
| 2005/0153773 | A1 * | 7/2005 | Nguyen et al. | 463/25 |
| 2005/0227760 | A1 * | 10/2005 | Vlazny et al. | 463/28 |
| 2006/0068898 | A1 * | 3/2006 | Maya | 463/25 |

FOREIGN PATENT DOCUMENTS

| | | |
|---|---|---|
| DE | 4200254 | 8/1993 |
| DE | 19701214 | 7/1998 |
| JP | 8187352 | 7/1996 |
| WO | 9847115 | 10/1998 |
| WO | 0003775 | 1/2000 |

OTHER PUBLICATIONS

International Search Report on PCT/AU01/00497.

* cited by examiner

*Primary Examiner* — Seng H Lim
(74) *Attorney, Agent, or Firm* — McAndrews, Held & Malloy, Ltd.

(57) ABSTRACT

A gaming machine is provided, which is arranged to play a game having 2 modes wherein the base game, when in the first mode, has a standard set of features and when in the second mode has an enhanced set of features which improve its attractiveness to players. The first game mode is available to all players and the second enhanced game mode is made available to players who have established membership in a group by inserting a members card.

15 Claims, 7 Drawing Sheets

BONUS MODE IS OFF

CREDIT 100 BET 20 WIN 40

| | | | | |
|---|---|---|---|---|
| C | J | S | 10 | J |
| S | 9 | 9 | J | A |
| A | Q | 10 | S | 10 |

FIG. 5

BONUS MODE IS ON

CREDIT 120 BET 20 WIN 40

| | | | | |
|---|---|---|---|---|
| C | J | S | 10 | A |
| S | 9 | Q | J | J |
| 10 | 9 | A | S | 10 |

FIG. 6

MEMBERSHIP REWARD SYSTEM

CROSS-REFERENCE TO RELATED APPLICATIONS

The present application relates to, and claims priority from, U.S. patent application Ser. No. 10/275,364, filed on Nov. 4, 2002, entitled "Membership Reward System," which in turn claims priority as a national stage entry of PCT/AU01/00497, filed on May 2, 2001, which claims priority to Australian Application No. PQ 7264, filed on May 3, 2000, each of which is herein incorporated by reference in its entirety.

INTRODUCTION

The present invention relates to gaming machines of the type generally known as slot machines, fruit machines, card machines or poker machines and in particular, the invention provides an improvement whereby players are rewarded for frequenting a particular establishment.

BACKGROUND OF THE INVENTION

Gaming machines are typically installed in large numbers at casinos and clubs which compete against one another for the custom of patrons wishing to play their games. Typically, this competition involves providing attractions such as the latest games, promotions associated, with or additional to the games played on their gaming machines and large incrementing bonus jackpots.

These attractions work to some extent, but the smart gamblers choose to play at establishments based on the current promotions that are being run, or the current size of the incrementing jackpots, and so there is a certain fluctuation in patronage due to the fickle nature of the patrons and the changing attractions of the promotions being run.

Some establishments have addressed this problem over the years by providing loyalty schemes. There exist many different systems used by clubs and casinos where regular players are rewarded. Some are manual where players that are recognised as spending a lot of time playing the machines are given free meals or discounts. More sophisticated systems involve players being sold or given a plastic card (eg. magnetic stripe or smartcard) that they can insert into a special reader on the gaming machines at the applicable club/casino. Points are accumulated at a fixed rate and stored on the card or in a central account. When the player accumulates a fixed number of points they become eligible to redeem them in exchange for goods. Players are usually given a range of goods to choose from where the number of points that need to be redeemed for each item varies depending upon the value of the item.

SUMMARY OF THE INVENTION

The present invention provides a gaming console having a display means, player input means, and control means arranged to control images displayed on the display means in response to player inputs and game outcomes of games run on the console by the player, the console being characterised in that it is arranged to operate in at least two modes, including a first normal mode and a second loyalty enhanced mode, wherein the first mode is available to all players and the second mode is made available only to players who have established themselves as eligible members of a club or other special group.

In various embodiments of the invention, the second mode may be distinguished from the first mode by providing higher prizes or additional prizes, allowing additional game features either as standard features, or as purchasable features within a standard game, or by providing eligibility to additional feature games, and bonus or jackpot prizes.

In the preferred embodiment, the main, or base game will be a card game or spinning reel game with or without additional feature games, but may also be a keno or bingo game, or any other game which can be provided on a gaming console of this type.

Membership of the eligible group may be signified by use of special keys, passwords or other identification means, but preferably by way of an identification card. The loyalty system may be implemented on "stand alone" consoles and on networked consoles. In the case of networked systems, player details can be maintained on a network server, or a dedicated loyalty system server for example, and the player identification card or other identification means can be used only to identify the player to the system. In the case of stand alone gaming consoles, the console will be provided with a card reader that reads a special membership card. When the card is inserted into the card reader the console will recognise the player as a member and the player will become eligible for the features of the loyalty enhanced mode. It is not essential, although it is preferable, that the console recognises the player's identity for the enhanced mode to operate, only that the player be recognised as a member of the class eligible for the enhanced mode.

In the case where the second mode provides a feature game, the feature game may be an independent second screen game. Alternatively, a bonus feature may be related to particular outcomes on the main game, such as providing prizes for outcomes over a certain level or containing certain indicia. The loyalty feature may also be related to a system event in a linked system and may for example, involve providing eligibility to a progressive jackpot.

Some specific examples of bonus rewards that can be provided to a player when their membership loyalty card is inserted may include:

a) In the event that 3 scatter symbols are spun up in a bought game, 10 free games are awarded.
b) In the event that an EYE symbol appears at the same time on reels 2 & 4, pay a bonus of 5 credits for every KING that appears in the next 20 games.
c) Every time a substitute symbol substitutes for another symbol in a win, a second screen feature is awarded, which pays a bonus prize.

Where features already exist as part of a standard game, and are available independently of a loyalty card being inserted, some or all of those features may be extended when a player's loyalty card has been inserted:

a) When a trigger comprising 3 or more scatter symbols occurs without the card inserted, 10 free games are awarded, but when the game trigger occurs with the loyalty card inserted into the machine's card reader, 20 free games are awarded.
b) When a loyalty card is not inserted, 2 or more substitute symbols appearing in a win, triggers a second screen feature, whereas, while the loyalty card is inserted only 1 or more substitute symbols are required to trigger the same feature.

BRIEF DESCRIPTION OF THE DRAWINGS

Embodiments of the invention will now be described by way of example with reference to the accompanying drawing in which:

FIGS. 5, 6, & 7, are game screens illustrating a game sequence which demonstrates the invention.

DETAILED DESCRIPTION OF THE PREFERRED EMBODIMENT

In the following detailed description the methodology of the embodiments will be described, and it is to be understood that it is within the capabilities of the non-inventive worker in the art to introduce the methodology on any standard processor-based gaming console by means of appropriate programming.

Figure 1:
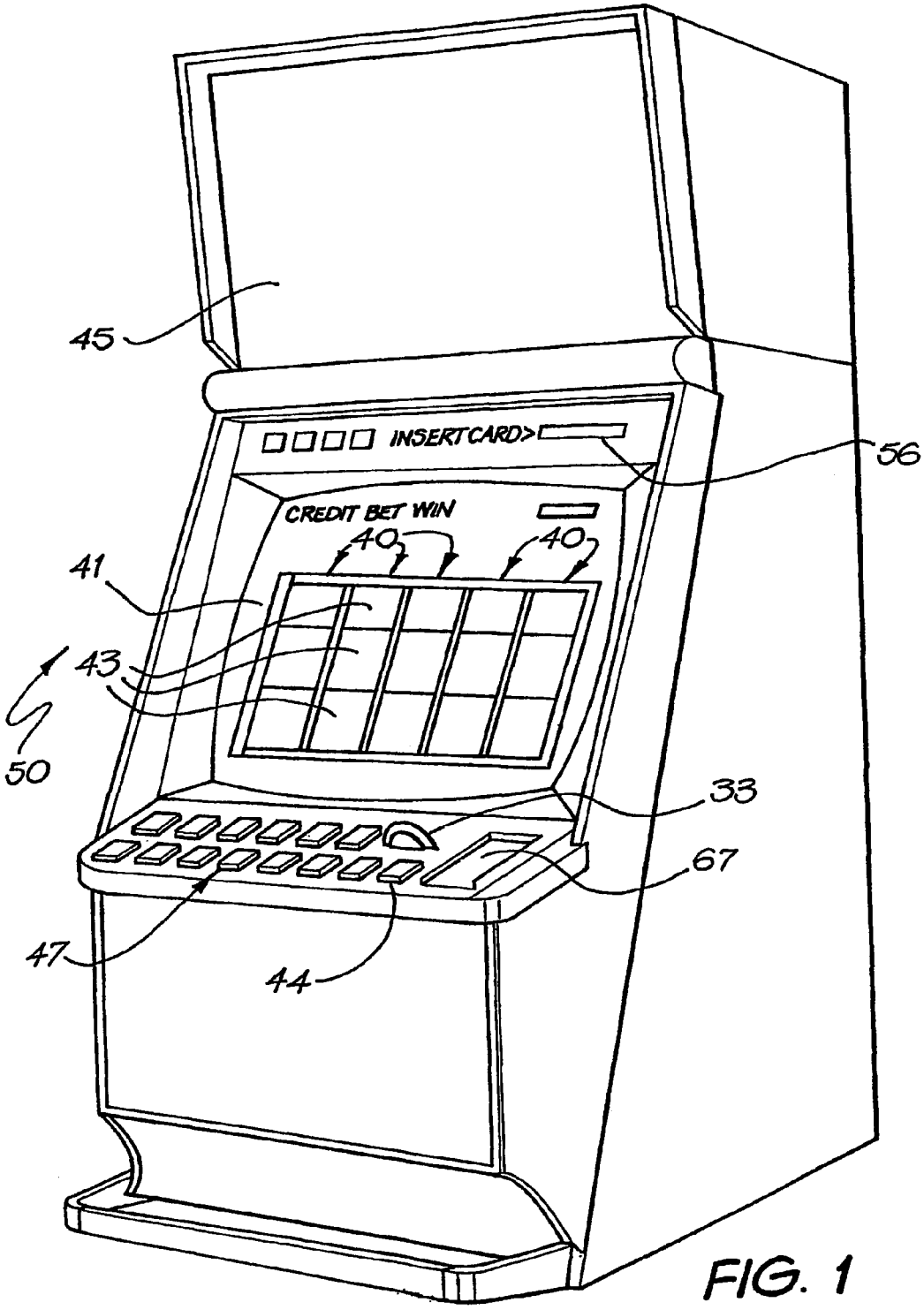
FIG. 1 illustrates a conventional video slot machine on which the embodiment of the present invention is provided.

Referring to FIG. 1 of the drawings, a first embodiment of the invention is implemented in relation to a slot machine 50 of the type having a video display illustrating a plurality of rotatable simulated reels 40 carrying symbols 43. During a game, the plurality of simulated reels are spun and when the reels stop spinning, a part of each reel is visible displaying a subset of the symbols on the respective reel. The console is arranged to pay a prize on the occurrence of a predetermined symbol or combination of symbols appearing together on the visible parts of the reels.

The prize paying combinations can be any of the combinations found on known spinning reel style slot machines, or may be a new set of combinations derived specifically for machines according to the invention.

In the slot machine 50 illustrated in FIG. 1, the game is initiated by pressing a button 44, however, it will be recognised by persons skilled in the art that this operating mechanism might be replaced by a pull handle actuator, or a touch screen sensor, in other embodiments of the invention. Credit is established on the slot machine by inserting coins into the coin slot 33, inserting a banknote or ticket into the bill acceptor 67 or possibly by inserting a card into the card reader and transferring credit either from an account held at the casino or at a financial institution or by transferring a credit from a stored value on the card itself.

The top box 45 on top of the slot machine 50 displays the various winning combinations for which a prize is paid on this machine.

In the embodiment of FIG. 1 a series of function switches 47 are also provided for selection of the bets and lines to be included in the game.

Games provided in embodiments of the present invention are modified versions of the current genre of Multiline 5 Reel Video games. These games operate on a video screen 41 displaying 5 separate reels 40. Referring specifically to the embodiment of FIG. 1, three symbols 43 from each of the video reel strips are viewed on screen at any one time, for each of the 5 reels. The players have an option of playing 1, 3, 5, 7 or 9 different lines.

While the slot machine illustrated in FIG. 1 is of the simulated-spinning reel type, the present invention is equally applicable to any type of game found on the current generation of video slot machines and could also be applied to physical reel machines. The primary game of the slot machine will operate in the conventional manner and its operation will not be described in detail.

Figure 2:
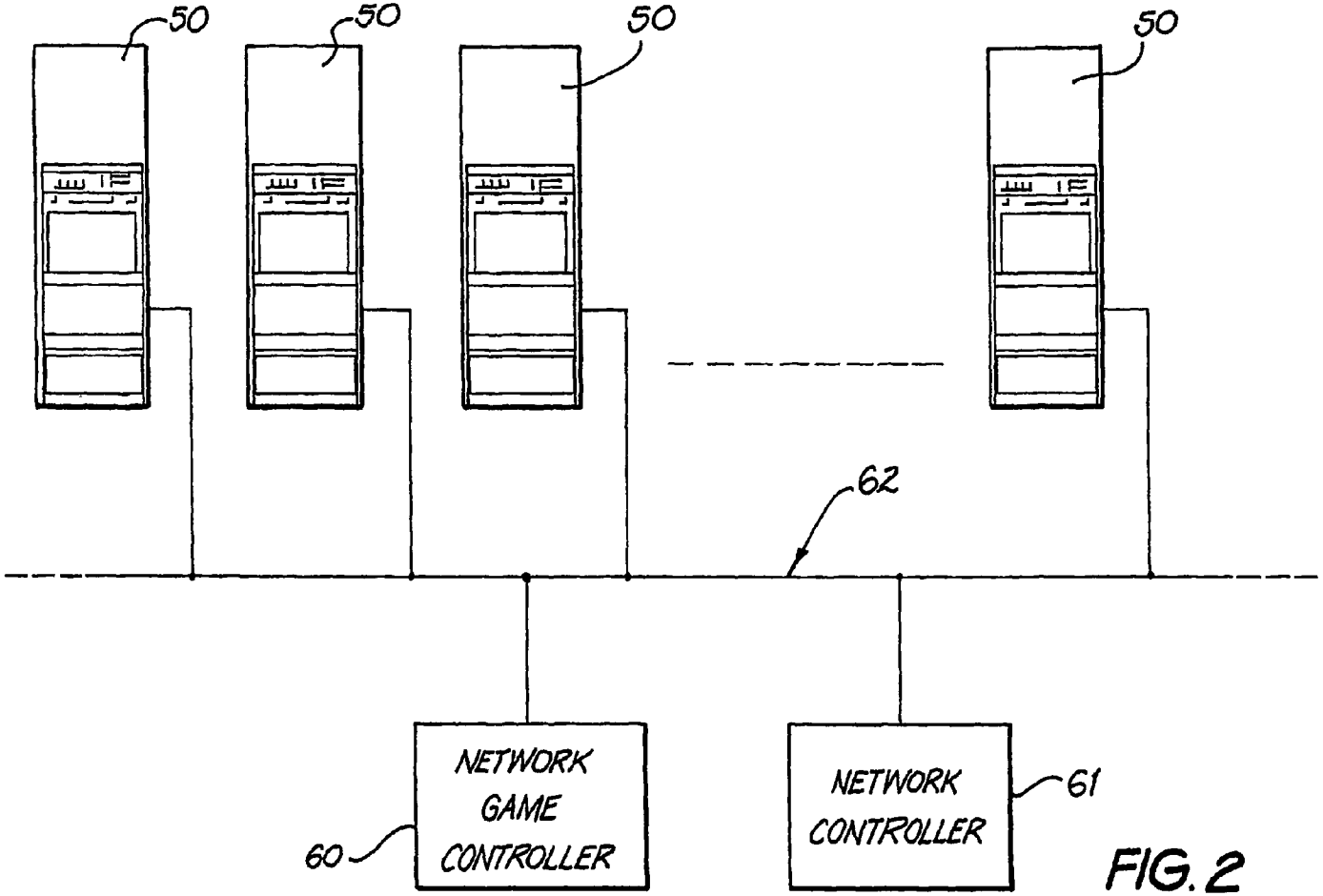
FIG. 2 schematically illustrates a network of gaming machines.

Referring to FIG. 2, a number of gaming consoles 50 are preferably connected in a network via a communications system 62, and the network controller 61. A network game controller 60 is also provided on the communications network 62 to control the accumulation of linked progressive prizes and the awarding of jackpots.

In a networked embodiment such as that shown in FIG. 2, the loyalty membership system may be implemented on either the network controller 61 or, the network game controller 60 or, alternatively a separate dedicated server (not shown) could be used to implement the loyalty membership system. Alternatively in a stand alone embodiment the functionality of the loyalty membership system is built into the controller of the gaming console itself.

Figure 3:
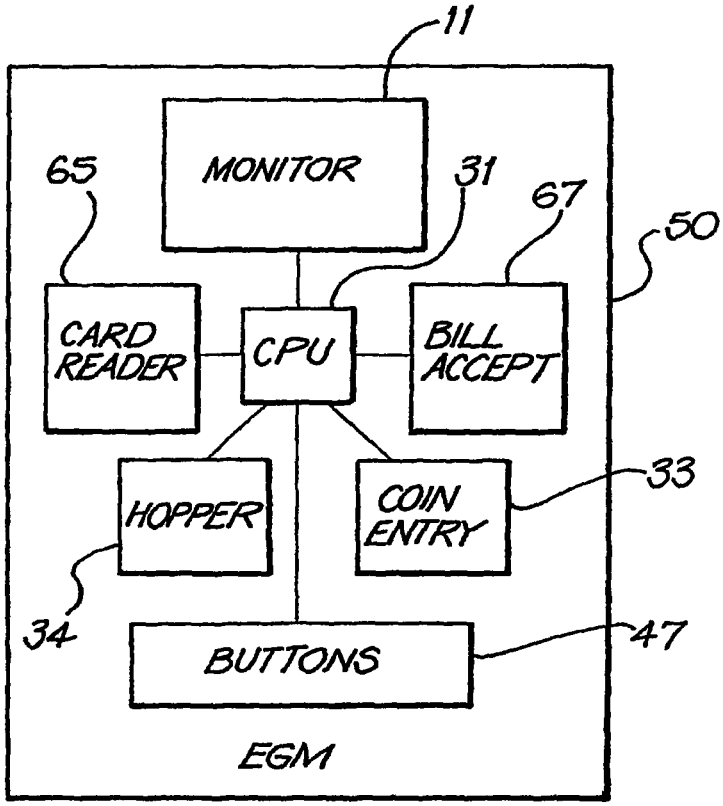
FIG. 3 is a block diagram of the gaming machine of FIG. 1, showing major functional elements.
Figure 4:
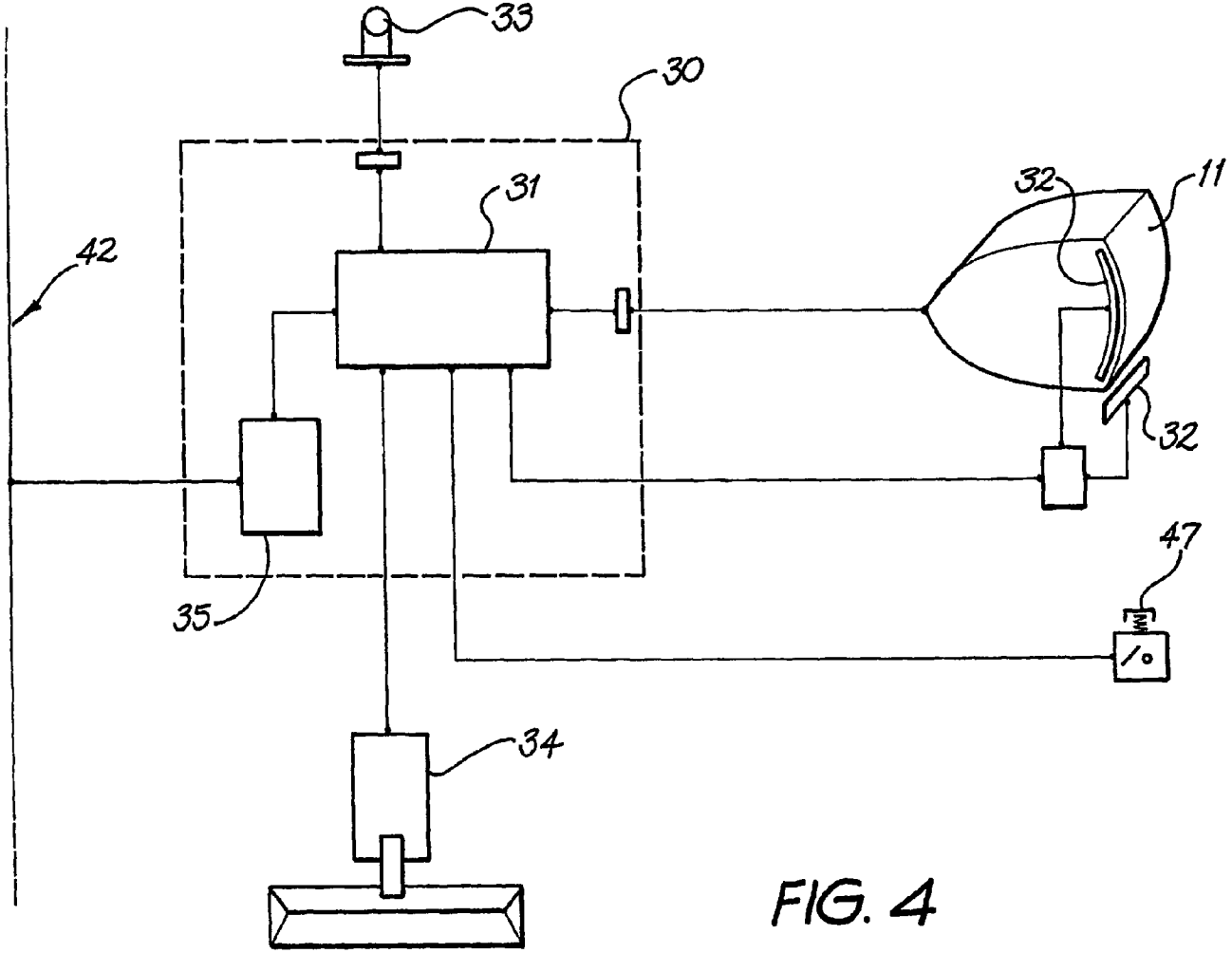
FIG. 4 is a further block diagram of a slot machine of FIGS. 1 and 3, showing optional touch screen and network connection functions.

The program to implement the base game described above, and to provide the normal mode of operation and the loyalty enhanced mode, runs on a standard gaming console control processor 31 as illustrated schematically in FIGS. 3 and 4. This processor forms part of a controller 30 which drives the display screen 11 and receives player input signals from push button switches 47. Alternatively, player inputs may be made by way of touch input signals from touch sensors 32. The console also receives coin input pulses from a coin chute mechanism 33 to establish a player credit and includes a coin payout mechanism or hopper 34. Connection to the communications network 42 is via a network interface 35.

In networked embodiments, the operation of the loyalty membership system is split between the game console 50 and the network game controller 60 with card reading and reward features being provided within the game console 50 and membership records being held on the central game controller with the identification and member information being passed between each participating machine 50 and the network controller 61 via the network 62. In the stand alone embodiment, the membership information is carried on a card read by the card reader, or alternatively the card simply signifies membership of a group entitled to additional features.

Referring again to FIGS. 1 and 3, each of the gaming machines within a gaming venue will preferably have a card reader 65 installed. Players are able to insert a membership card (smartcard or magnetic stripe card) into a gaming machine when they play, in order to qualify for additional member bonus features.

A manufacturer, club or casino can use the membership reward system to maintain player loyalty by issuing a members identification device such as a card (magnetic stripe or smartcard) to members. A club or casino may require a membership fee or a minimum monthly attendance before a player will be issued a card.

By inserting the member's card into the card reader of a gaming console, the player will become eligible for bonuses that they would not be eligible for without their card inserted. In one embodiment, special bonus features are provided that are independent of the base game, such as a special linked progressive jackpot system to be available only when the member card is inserted into the card reader of the machine.

A variety of features are suitable for selective inclusion in a game or as an extension to a game where a member's loyalty card is inserted into a machine. The embodiment described below is for a special feature incorporated into the base game to be made available when the card is inserted.

For the following example, there is a special second-screen bonus feature available that is triggered by the occurrence of 3 or more S symbols in a base game. The player is only eligible for this feature when their player card is inserted.

Referring to FIG. 5, a game display is illustrated for a game that was played without the member's card having been inserted. Even though 3 S symbols accrued, the feature is not triggered because the player is ineligible. However, the player is paid 40 credits for the 3 scattered S symbols as a part of the base game.

Figure 7:
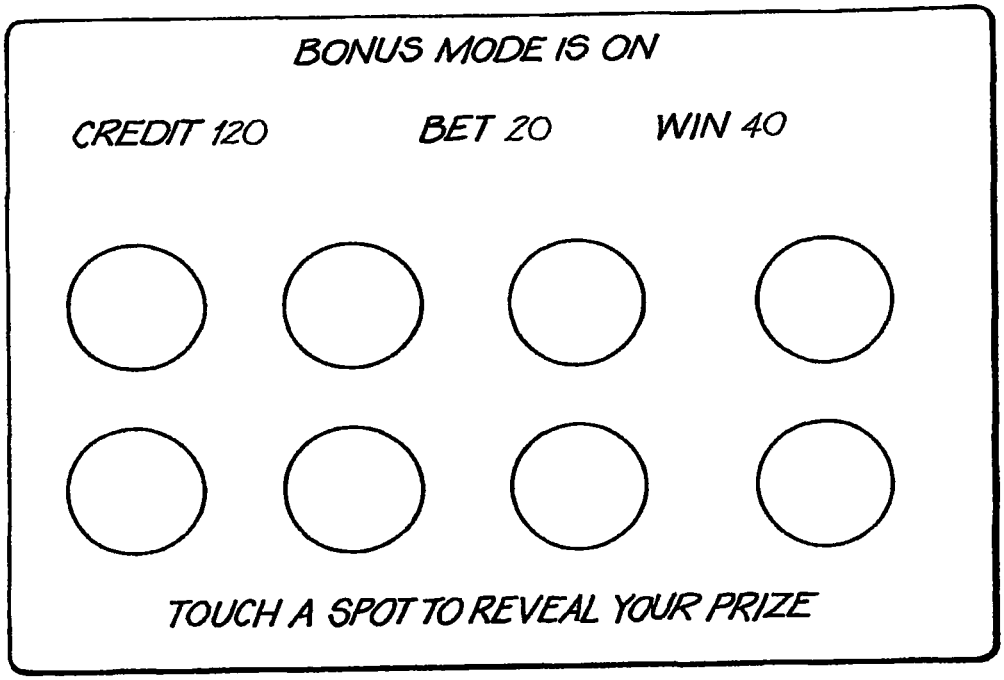

FIG. 6 illustrates a game display of a game played after the player has inserted their member's card. This time the bonus second-screen feature is triggered because the trigger combination of three or more S symbols occurred while the player card was inserted. The screen of FIG. 7 is then automatically presented. The second screen game illustrated in FIG. 7 may be common to all consoles in the establishment or at least a subset of consoles such that the same bonus feature is offered regardless of the base game when the membership card is inserted.

The bonus game in this instance is a simple "pick the window" type game where the player is invited to select one of eight spots on the screen by touching the selection. The screen is touch sensitive allowing the selection to be registered by the controller 31 (see FIGS. 3, 7, 4) and a prize associated with the selected spot is then revealed.

Embodiments may provide member-only features triggered from within a game as described above or features that are randomly triggered independently of the game being played and occur randomly at a predetermined average rate simply as a result of the membership card being inserted into the console.

In a further embodiment, the bonus feature may also be triggered by a conventional trigger regardless of whether the member card is inserted, however, when the card is inserted, the game may pay bigger prizes or more bonus games may be awarded when predefined trigger conditions occur.

Figure 8:
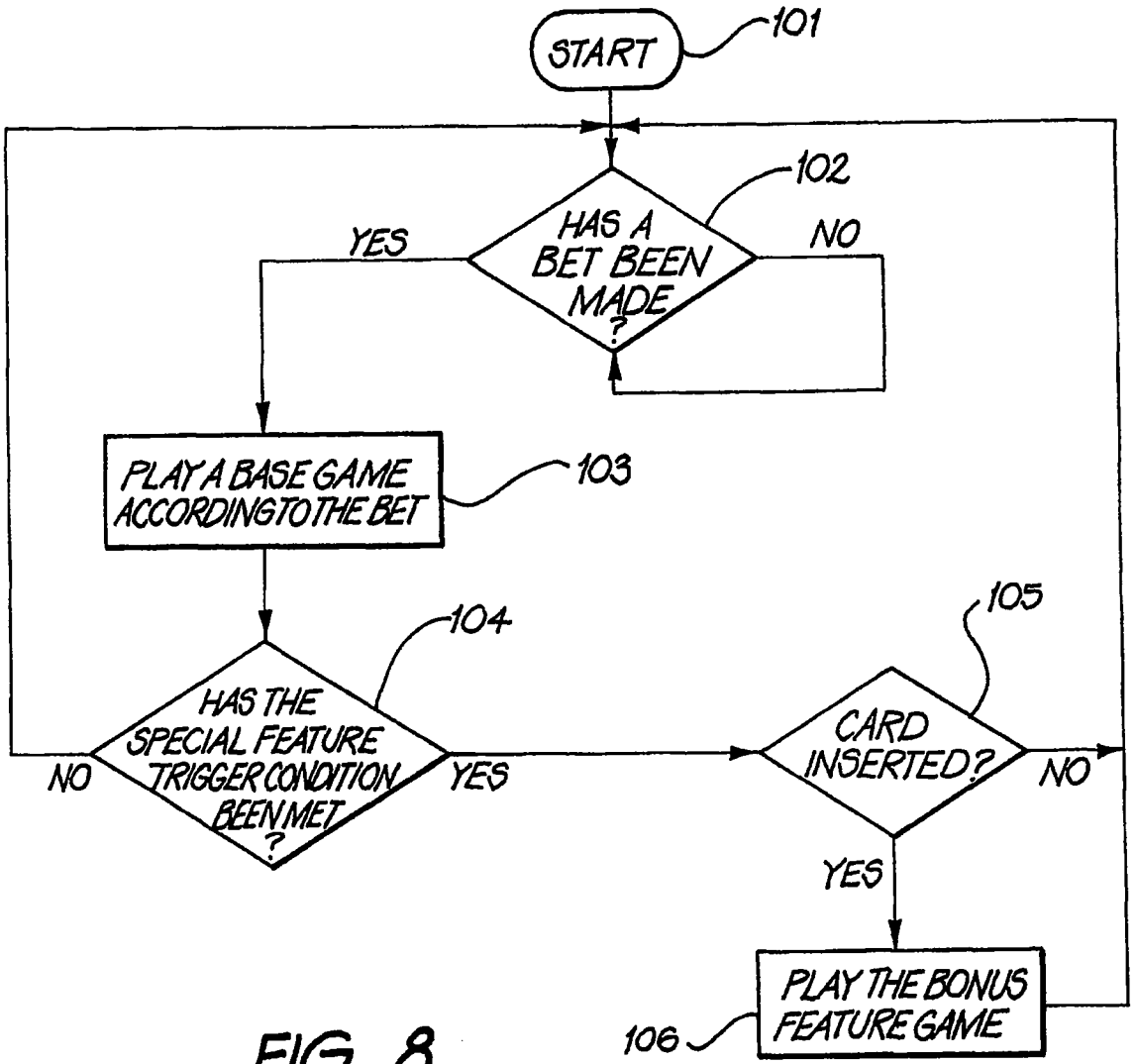
FIG. 8 is a flow chart showing the method of implementing the game described with reference to FIGS. 5, 6 & 7.

Referring to the flowchart of FIG. 8, the process step START (101) is an initialisation step performed when a player establishes a credit by inserting cash or transferring credit to the console. The console tests for the selection of a wager amount in step 102 to initiate a game. When a wager has been made, the base game plays in step 103 in accordance with the wager. Once the base game has completed the outcome is tested in step 104 to determine if any trigger conditions have occurred. In this context step 104 is only concerned with those trigger conditions which are activated when a member card is present. The base game may include other trigger conditions for features that are always provided, and these are not specifically described here. If no trigger conditions are detected, the console again waits for a wager in step 102, however, if a member bonus trigger condition has occurred, a test is performed at step 105 to determine if a member card has been inserted and if it has the bonus feature game is played at step 106. If step 105 does not detect a member's card present, the console again waits for a wager at step 102.

The bonus feature may also be available as a standard feature of the base game, such that other triggers (eg; combination triggers) in the game itself, may cause the feature to be invoked. The feature may be game specific, where a bonus feature that is built into the game and usually triggered by a certain random event or combination trigger is triggered by additional triggers when the member card is present. This also means that the expected return to player percentage of the applicable gaming machines will preferably be higher for a player taking part in the loyalty system than for one that is not.

The same approach could also be applied where the bonus is generic to all of the gaming machines that participate in the membership loyalty scheme. For example, a linked, progressive jackpot system may allow players to play the linked bonus feature in a larger number of circumstances or multiple progressive jackpots may be provided, of which some are only available when the members card is inserted. Similarly there could be a dedicated feature associated with the participating gaming machines that could be either game specific or generic that is only available to players who have inserted their members card. Hence players who do not use the members card will never be eligible to play that particular feature.

Preferably, an icon and message will be displayed on the game screen while the player's card is inserted to indicate that the player is currently eligible for special bonus features. When the card is removed the icon may disappear or be dulled out to further encourage the player to insert a card. The feature that the player becomes eligible for when their card is inserted may be of several different types.

Of the many types of features possible, some can be an extension to the base game. For example in a standard keno game 20 numbers are selected from a total of 80 and, if they match certain of the numbers that the player selected, a prize is awarded. When the player inserts their card the same keno game will allocate 21 numbers from the 80. That is, the apparent probability of a win will be increased by giving the player an extra number for every game. (Note that in some embodiments the probability may or may not be actually increased, but the player perception will be that the loyalty system results in a higher win probability).

Other types of feature can provide an extension to the game specific feature. This may be done by allowing the same trigger combination to provide a better feature when the members card is inserted (eg. instead of the usual 10 free games the player gets 20 free games or 10 free games with wins doubled). Alternatively the probability of the trigger may increase (eg. instead of 3 or more scatters triggering the feature, 2 or more will).

In some embodiments, the loyalty system player identification device may serve more than one function. For example, the Player Identification device may be a cashless gaming card such as a smartcard, where the card earns the player identification information and additionally, a monetary value stored on it. When inserted into the card reader, some or all of the monetary value can be transferred onto the credit meter of the gaming machine. Similarly, winnings can be transferred from the credit meter of the gaming machine onto the card, to be redeemed for cash when leaving the venue. The smartcards used for such a cashless system, when detected in the card reader of the gaming machine, can make the player eligible for certain bonus features while the card remains inserted in a similar manner to the other embodiments described above.

In another implementation of the member loyalty system a record of player option preferences is stored with the member information. This may also apply to the base game rather than just loyalty features. Possible options could be bet patterns, feature choices, favorite symbols, credit denominations game variables or similar. For example, a player may always bet maximum credits and may like to double-up on wins less than 100 credits. This information may be stored on their card or in the records held in the loyalty system on the network controller 61 so that when they move to another machine the bet will automatically be adjusted and they will be automatically taken to the double-up screen after wins of less than 100 credits and so on.

The member loyalty system may also add personality to the game being played. This might be done by holding details that are personal to the player and recorded in their account or on their card so that they can be incorporated into the bonus features. For example, a player information delivery system may greet the player by name, or a photograph or caricature of the player may be used as the top symbol in a spinning reel feature game.

In a further enhancement to embodiments of the invention, indication means are provided to advise a player when they are eligible for loyalty bonuses. This may take the form of a colour change in the background image of the display or a similar type of indication while the player is eligible for loyalty bonuses due to their card being present in the card reader of the gaming machine.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of providing an incentive reward to a holder of a player identifier who is a player of one of a plurality of gaming machines in a gaming system and is a participant in a membership loyalty scheme, each of the plurality of the gaming machines having (1) a player interface arranged to receive the player identifier, (2) a game controller arranged to play a base game, and (3) at least one bonus triggering condition including at least one member bonus triggering condition, the method comprising:

providing a base game via the game controller on the gaming machine being played by the player whether or not a player identifier has been received by the player interface of the gaming machine;

determining an occurrence of a member bonus triggering condition;

in response to determining said member bonus triggering condition, (1) determining whether a player identifier has been received by the player interface; and (2) activating a bonus in response to determining that a player identifier has been received by the player interface, wherein the activated bonus comprises a secondary game that is common on all of the plurality of gaming machines that participate in the membership loyalty scheme, irrespective of the base game provided on the gaming machine being played by the player.

2. The method of claim 1, wherein the secondary game includes a bonus feature that includes at least one bonus game to provide a chance of a progressive jackpot prize, and wherein said activating a bonus includes providing a chance of an additional progressive jackpot prize.

3. The method of claim 1, wherein the secondary game includes a bonus feature caused by an occurrence of said member bonus triggering condition, said bonus feature including at least one bonus game that provides at least a chance of a prize; and wherein said activating a bonus includes providing said bonus feature with additional bonus games, the additional bonus games providing monetary pay out, whereby the monetary pay out causing an increase in a total prize awarded from said bonus feature due to the additional bonus games.

4. The method of claim 1, wherein the secondary game includes a bonus feature caused by an occurrence of said member bonus triggering condition, said bonus feature including at least one bonus game that provides at least a chance of a prize; and wherein said activating a bonus includes increasing the size of said prize of said bonus feature.

5. The method of claim 1, wherein said player identifier is one of a plurality of player identifiers that indicate that the holder is part of a special eligibility group; and wherein an occurrence of said member bonus triggering condition includes the event of any one of the plurality of player identifiers being received by the interface.

6. The method of claim 5, wherein the gaming machine is communicably connected to a central electronic storage, the method including:

maintaining in the central electronic storage electronic information identifying each of the plurality of player identifiers that indicate that the holder is part of a special eligibility group; and using the electronic information to identify whether a received player identifier is one of the plurality of player identifiers that indicate that the holder is part of a special eligibility group.

7. The method of claim 1, wherein said activating a bonus includes increasing the expected return to player percentage of the gaming machine.

8. The method of claim 1, wherein the gaming machine is capable of cashless play of the game, and further including using the player identifier to identify a monetary value that the holder of the player identifier can transfer to a credit meter of the gaming machine.

9. The method of claim 1, wherein the gaming machine is capable of configuration according to the preferences of a player, the method including using the player identifier to identify the preferences of the player and configuring the gaming machine in accordance with the references of the player in response to receive of the player identifier.

10. A gaming machine of a plurality of gaming machines that provide an incentive reward to a holder of a player identifier and is a participant in a membership loyalty scheme, the gaming machine comprising:

a player interface for receiving a player identifier;

at least one bonus triggering condition including at least one member bonus triggering condition; and a game controller configured to provide a base game playable by a player whether or not the player identifier has been received by said player interface;

said game controller configured to respond to an occurrence of a member bonus triggering condition by determining whether a player identifier has been received by said player interface;

said game controller configured to activate a bonus in response to determining that a player identifier has been received by said player interface, wherein the activated bonus comprises a secondary game that is common on all of the plurality of gaming machines that participate in the membership loyalty scheme, irrespective of the base game provided on the gaming machine.

11. The gaming machine of claim 10, wherein the player identifier is one of a plurality of different player identifiers and wherein said game controller activates the bonus in direct response to receipt of any one of the player identifiers at the interface.

12. The gaming machine of claim 11, wherein the player interface is operable to receive a player identifier that is not one of said plurality of different player identifiers and wherein the gaming machine communicates with a remote device through a network to determine if a received player identifier is one of the said plurality of different player identifiers.

13. A gaming system including a plurality of gaming machines that each provide an incentive reward to a holder of a player identifier and is a participant in a membership loyalty scheme, each gaming machine comprising:

a player interface for receiving the player identifier;

at least one bonus triggering condition including at least one member bonus triggering condition; and a game controller configured to provide a game playable by any player whether or not the player identifier has been received by said player interface;

said game controller configured to respond to an occurrence of a member bonus triggering condition by determining whether a player identifier has been received by said player interface;

said game controller configured to activate a bonus in response to determining that a player identifier has been received by said player interface;

wherein the gaming system further includes a computational facility at which receipt of a monetary payment from a potential player of one of said gaming machines is recordable, said computational facility arranged to control the status of player identifiers to activate the bonus, wherein the activated bonus comprises a secondary game that is common on all of the plurality of gaming machines that participate in the membership loyalty scheme, irrespective of the base game provided on the gaming machine.

14. The gaming system of claim 13, wherein said computational facility is in electronic communication with each of said gaming machines and configured to control for which player identifiers each gaming machine activates the bonus.

15. The gaming system of claim 13, wherein said computational facility includes a card issuer that includes a said player identifier and wherein the player interface of each gaming machine is a reader of cards issued by the card issuer.

* * * * *